US007516961B1

(12) United States Patent
Zylka

(10) Patent No.: US 7,516,961 B1
(45) Date of Patent: Apr. 14, 2009

(54) TOY WATER CANNON GAME

(76) Inventor: Brian K. Zylka, 21685 Jordan Way Dr., South Lyon, MI (US) 48178

( * ) Notice: Subject to any disclaimer, the term of this patent is extended or adjusted under 35 U.S.C. 154(b) by 0 days.

(21) Appl. No.: 12/101,986

(22) Filed: Apr. 12, 2008

(51) Int. Cl.
*A63B 67/00* (2006.01)

(52) U.S. Cl. ..... 273/349; 273/356; 273/357

(58) Field of Classification Search ..... 273/349, 273/350, 355–357, 440, 442, 449, 453, 457, 273/459
See application file for complete search history.

(56) References Cited

U.S. PATENT DOCUMENTS 1,489,191 A * 4/1924 Chester ..... 273/357
1,551,899 A * 9/1925 Michener ..... 273/349
2,299,551 A * 10/1942 McGahey ..... 446/161
2,340,649 A * 2/1944 Dawson ..... 273/356
2,859,037 A * 11/1958 Howard ..... 273/350
3,434,716 A 3/1969 Schwartz
3,559,989 A * 2/1971 Breslow ..... 273/450
3,921,980 A 11/1975 Artzer
4,040,622 A 8/1977 Sinnott
4,223,894 A * 9/1980 Fabricant ..... 273/349
4,412,680 A * 11/1983 Zorn ..... 273/349
5,011,161 A 4/1991 Galphin
5,344,156 A 9/1994 Levin
D370,036 S 5/1996 Jaeb et al.

* cited by examiner

*Primary Examiner*—Mark S Graham
(74) *Attorney, Agent, or Firm*—Crossley Patent Law; Mark A. Crossley

(57) ABSTRACT

A toy water cannon game wherein opposing players use water cannons to herd cannon balls from perches on the boat deck into the scoring holes. The rotational capability of the unsinkable boat within the reservoir adds difficulty and realism. The game is designed to keep a majority of the water within and to continually recycle that water. The player to first clear the deck of cannon balls wins.

17 Claims, 7 Drawing Sheets

TOY WATER CANNON GAME

BACKGROUND OF THE INVENTION

Almost any age player enjoys some form of game, whether a board game of action, a more mental game, a toy game, or any combination thereof. When involving young players, game play is often most enjoyable with games of action wherein players are involved in thinking and manipulation of some game piece or pieces. Children especially enjoy games of action wherein they experience some sort of mess making, even if minimal, or at least the illusion of mess making. Young players are often quickly bored with games with minimal action and no mess involved. The present game provides action, competition, minimal mess, and a way to keep score.

FIELD OF THE INVENTION

The toy water cannon game relates to games and more especially to an action water game for virtually all ages.

SUMMARY OF THE INVENTION

The general purpose of the toy water cannon game, described subsequently in greater detail, is to provide a toy water cannon game which has many novel features that result in an improved toy water cannon game which is not anticipated, rendered obvious, suggested, or even implied by prior art, either alone or in combination thereof.

To attain this, the toy water cannon game provides for water action with minimal extraneous water splash. The game provides an imaginative fort-like base surrounding a central reservoir. Towers on the fort are equipped with pivoting water cannons, resembling those of olden days' forts. The game is available with either two or four towers with cannons. The artistic presentation of the game adds romance and enjoyment to play. The removable boat deck is fitted with items typical to present day imagination of an olden pirate ship. Players compete in trying to be the first to "clear the deck" of their respective cannon balls. The boat is free to rotate within the reservoir to further add difficulty and realism to the game. Cannon pivot is limited so that players, especially young ones, are not tempted to shoot water outside of the game. The game floor and cannon limitations provide for continual recycling of the water used to play.

Many parts of the game are ideally made of synthetics such as plastic and others which are conductive to modern molding and formation techniques. Other appropriate materials are used as needing, including flexible hose.

Thus has been broadly outlined the more important features of the improved toy water cannon game so that the detailed description thereof that follows may be better understood and in order that the present contribution to the art may be better appreciated.

An object of the toy water cannon game is to entertain.

Another object of the toy water cannon game is to be understandable and playable by very young as well as older gamers.

And, an object of the toy water cannon game is to provide a game requiring physical action.

A further object of the toy water cannon game is to involve water such that players enjoy splash action.

An added object of the toy water cannon game is to continuously recycle the water in use during play.

These together with additional objects, features and advantages of the improved toy water cannon game will be readily apparent to those of ordinary skill in the art upon reading the following detailed description of presently preferred, but nonetheless illustrative, embodiments of the improved toy water cannon game when taken in conjunction with the accompanying drawings.

In this respect, before explaining the current embodiments of the improved toy water cannon game in detail, it is to be understood that the toy water cannon game is not limited in its application to the details of construction and arrangements of the components set forth in the following description or illustration. Those skilled in the art will appreciate that the concept of this disclosure may be readily utilized as a basis for the design of other structures, methods, and systems for carrying out the several purposes of the improved toy water cannon game. It is therefore important that the claims be regarded as including such equivalent constructions insofar as they do not depart from the spirit and scope of the toy water cannon game. It is also to be understood that the phraseology and terminology employed herein are for purposes of description and should not be regarded as limiting.

DETAILED DESCRIPTION OF THE DRAWINGS

Figure 1:
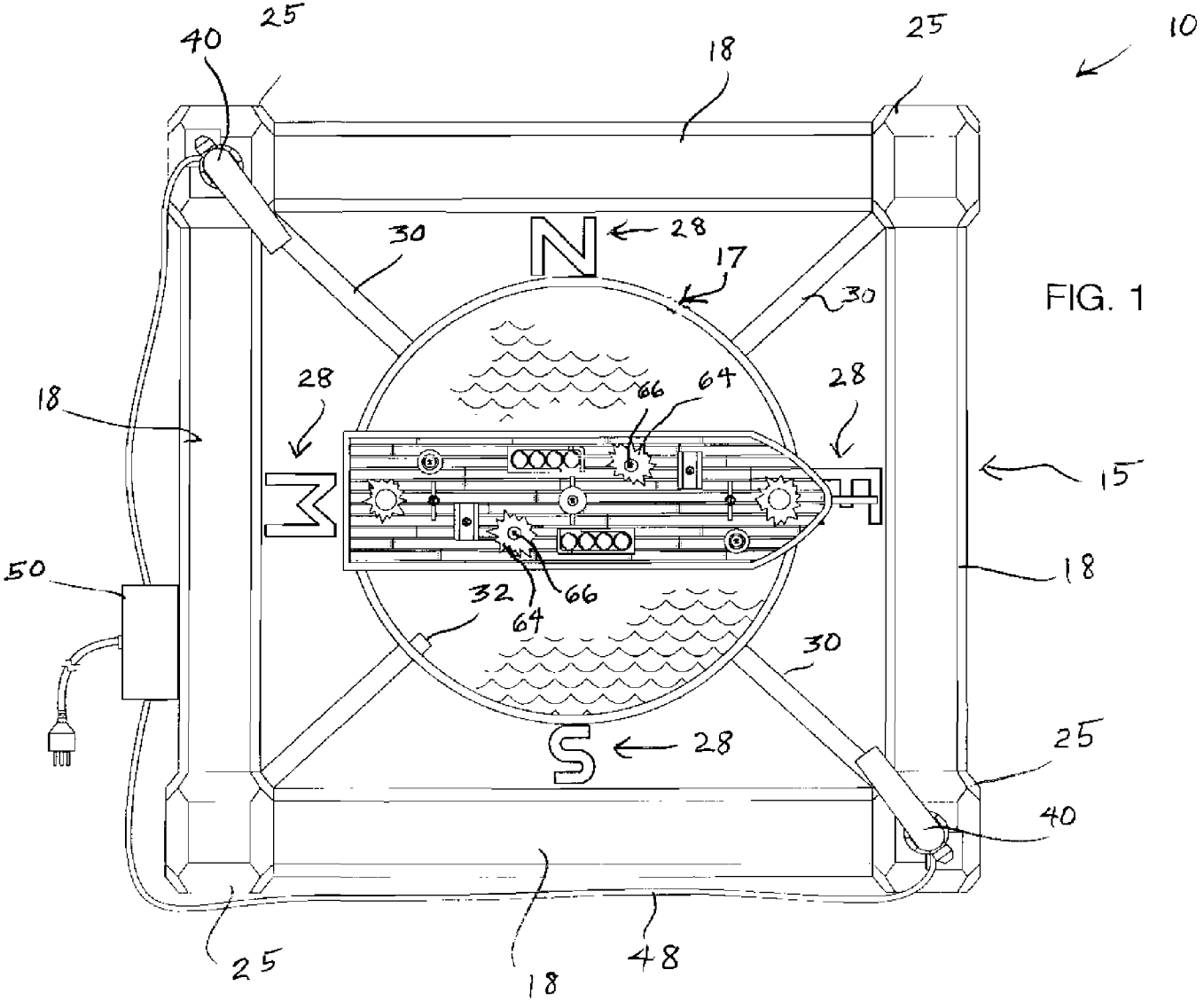
FIG. 1 is a top plan view.
Figure 2:
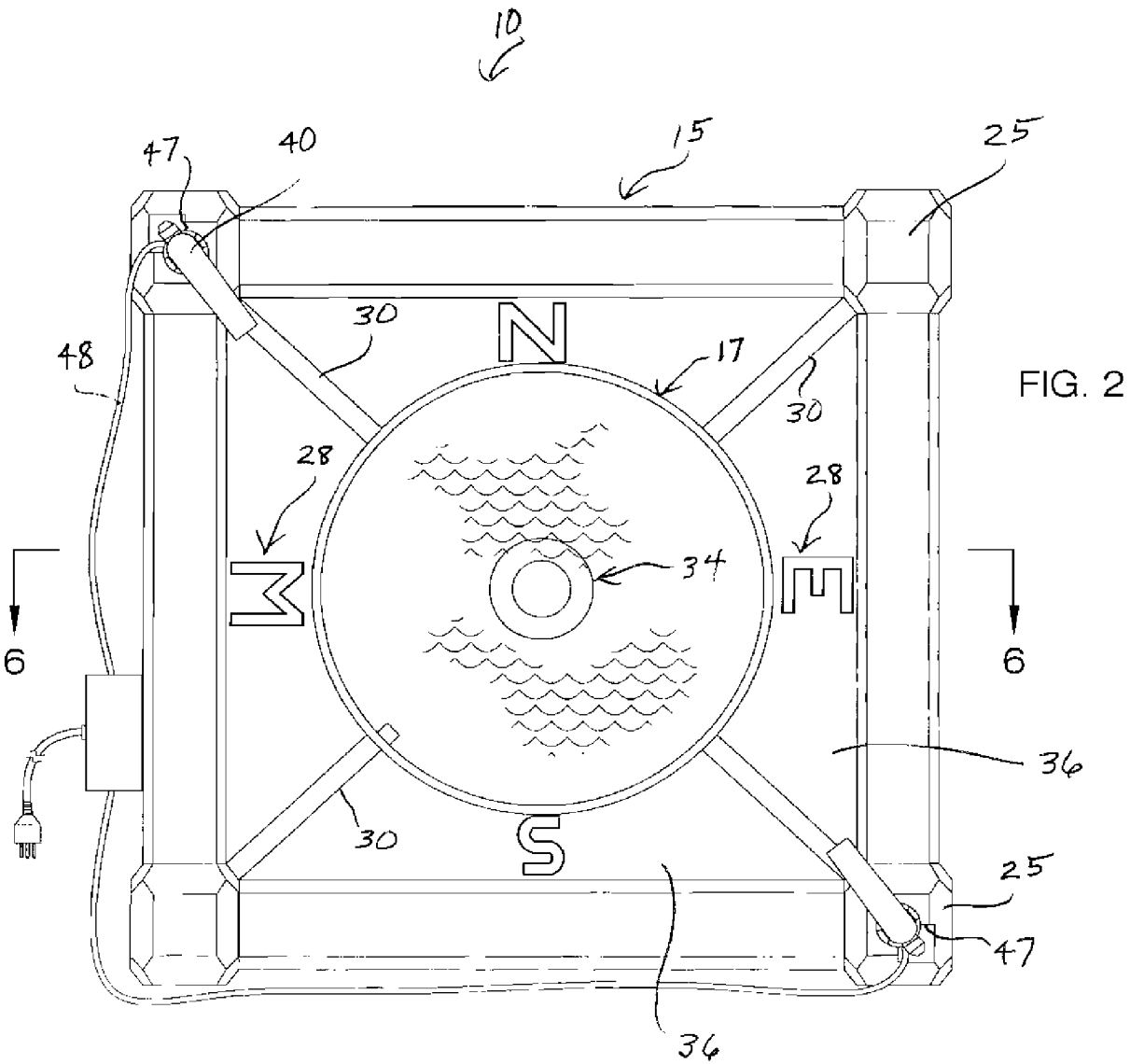
FIG. 2 is a top plan view without the boat.
Figure 3:
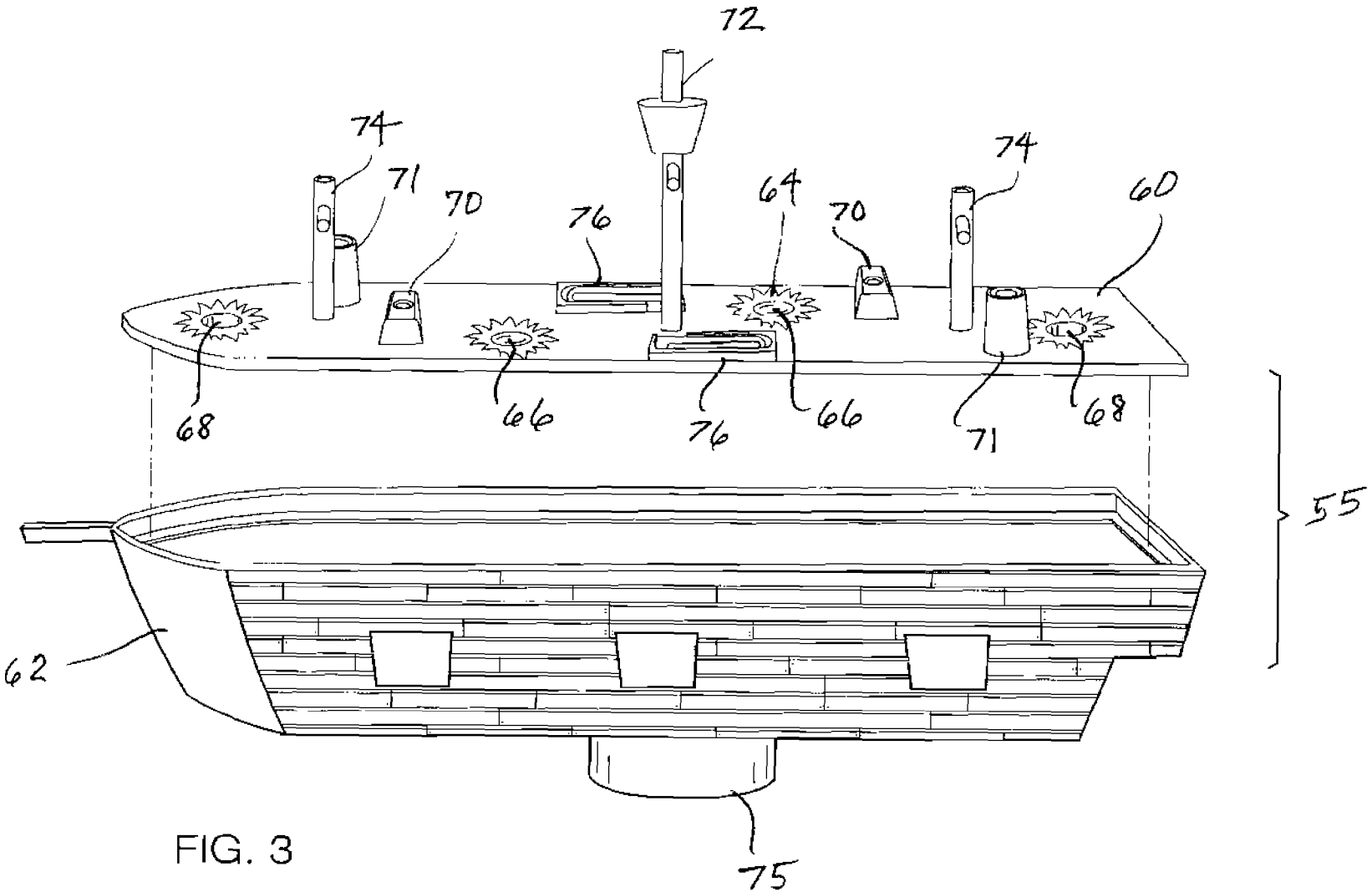
FIG. 3 is a perspective view of the boat with deck removed from the hull.
Figure 4:
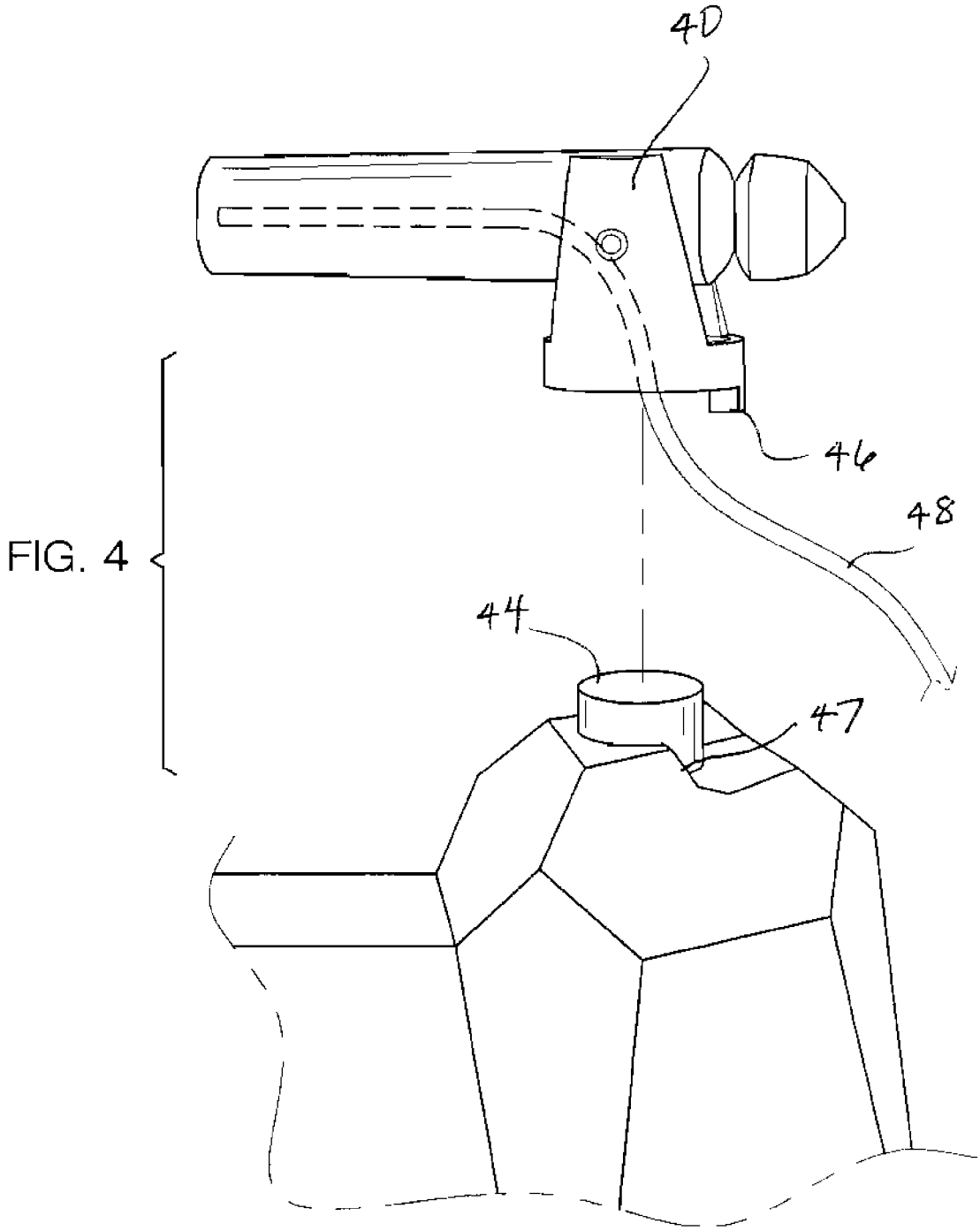
FIG. 4 is a perspective view of one cannon and the tower and swivel to which it mounts.
Figure 5:
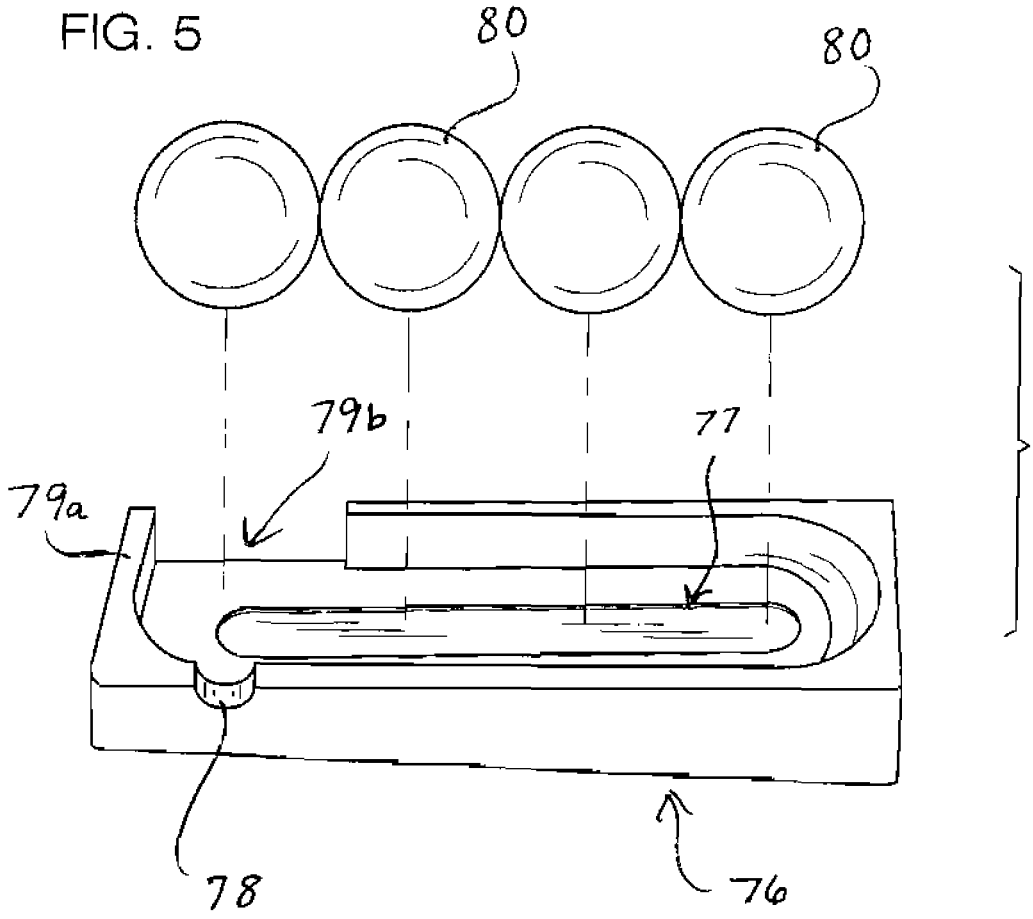
FIG. 5 is a perspective view of one cannon ball perch and related cannon balls.
Figure 6:
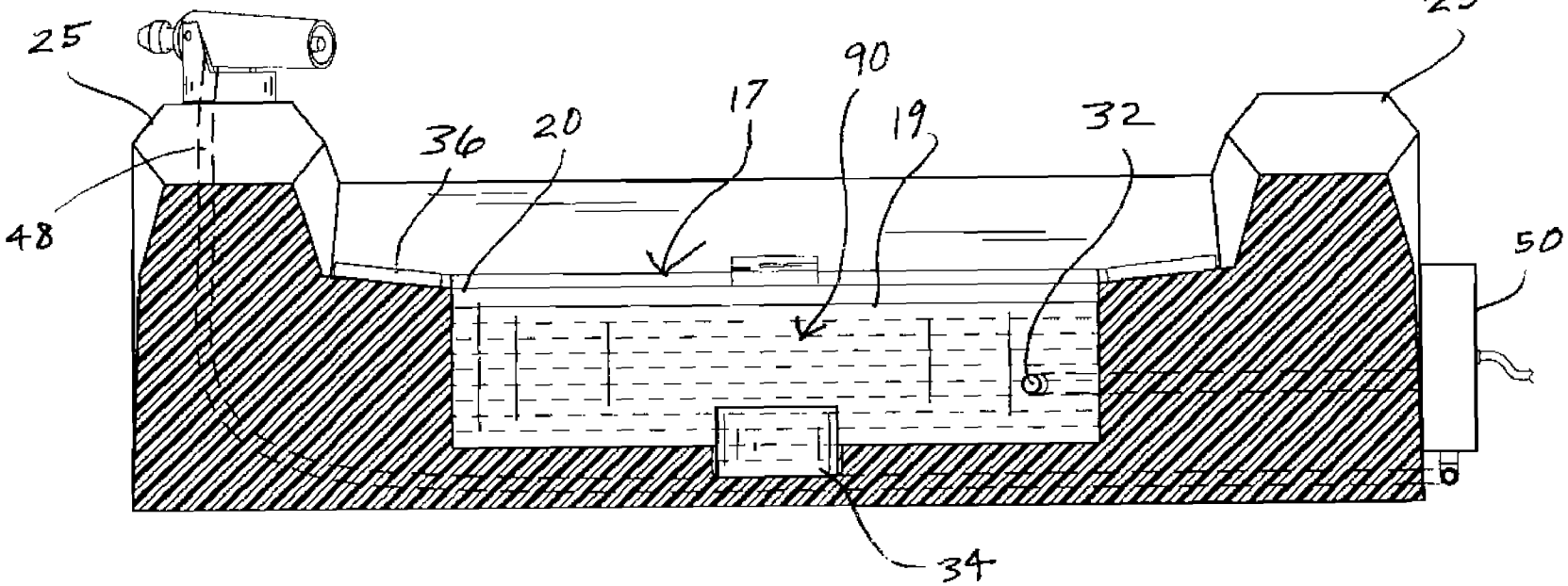
FIG. 6 is a later cross sectional view of FIG. 2.

With reference now to the drawings, and in particular to FIGS. 1 through 7 thereof, the principles and concepts of the toy water cannon game generally designated by the reference numeral 10 will be described.

Referring to FIGS. 1-6, the toy water cannon game 10 provides an action game 10 that is easily understood by even very young players. The game 10 comprises a square base 15 having four spaced apart walls 18 and a slanted floor 36 therebetween. The circular reservoir 17 is disposed in the center of the floor 36. The reservoir 17 further comprises a central rotational platform 34 in open communication with water 90 in the reservoir 17. The top 20 of the reservoir 17 is lower than the floor 36, thereby providing for water 90 to drain from the floor 36 into the reservoir 17. This drainage design and that of the boat 55 explained below, except for minimal extraneous splashing during play, provides for water 90 used in the game 10 to be continually recycled. The floor 36 further comprises the four compass points 28 comprising North, South, East, and West for added visual effect. Additionally the floor 36 also comprises a rib 30 between each compass point 28. Ribs 30 provide two functions. First, the ribs 30 add to compass points' 28 realism. Second, the ribs 30 provide structural integrity to the base 15. The base 15 is further comprised of four spaced apart towers 25 disposed at each of the corners on the base 15. At least two of each of the towers 25 has a swivel 44. Each tower 25 with swivel 44 further comprises a pair of spaced apart limits 47 adjacent to each swivel 44. A water cannon 40 is pivotally disposed on each swivel 44. A limit tab 46 is disposed on each cannon 40 and is in rotatable contact with the tower limits 47, whereby cannon 40 rotation is limited. The ideal pivotal limit is about 40 degrees. Players are thereby limited from extreme water 90 flow outside of the game 10. The electrical pump 50 supplies water 90 from the reservoir 17 via the water inlet 32, thence to each cannon 40. The boat 55 is removably disposed within the reservoir 17. The boat 55 has a hull 62 topped by a removable deck 60. The hull 62 has a sleeve 75 for pivotal fit to the rotational platform 34. The sleeve 75 supports the therefore unsinkable boat 55 while allowing the boat 55 to turn freely within the water 90, adding realism and complexity to the game 10. The rotational platform 34 and sleeve 75 are in open communication with the reservoir 17, whereby water 90 in the boat 55 drains, enabling the recycling of the water 90 and keeping the boat 55 at the desired level in the water 90. At least two rectangular cannon ball perches 76 are provided, with perch walls 79*a* substantially surrounding each perch 76. Each perch 76 further comprises a central elongated channel 77. The channel 77 and perch walls 79*a* of each perch 76 aid in retaining the cannon balls 80 until struck with water 90 from the cannons 40. The outlet 79*b* is disposed in one of the perch walls 79*a* of each perch 76 for cannon ball 80 escape. An access 78 is disposed in the perch wall 79*a* opposite the outlet 79*b* of each perch 76. The access 78 provides for water 90 to strike and move a cannon ball 80 out of the outline 79*b*. At least two scoring holes 68 are disposed within the deck 60 of the boat 55 for the receipt of cannon balls 80 washed to the holes 68 by water 90 from the cannons 40. The cannon balls 80 can be retrieved from the boat 55 by removing the deck 60. The plurality of masts is comprised of two short masts 74 and one main mast 72 which are removably fitted to the deck 60. At least two damage sites 64 are disposed on the deck 60. Each drainage site 64 resembles a cannon ball 80 strike. Each damage site 64 has a centrally disposed detent 66 whereby a cannonball 80 can be temporarily caught until dislodged by water 90. The pair of spaced apart treasure chests 70 is disposed on the deck 60. More than one obstacle 71 is disposed on the deck 60. The various features on the deck 60 add obstacles to the progress of cannon balls 80 toward the holes 68. The features on the deck 60 also add fun and realism to the game 10.

Figure 7:
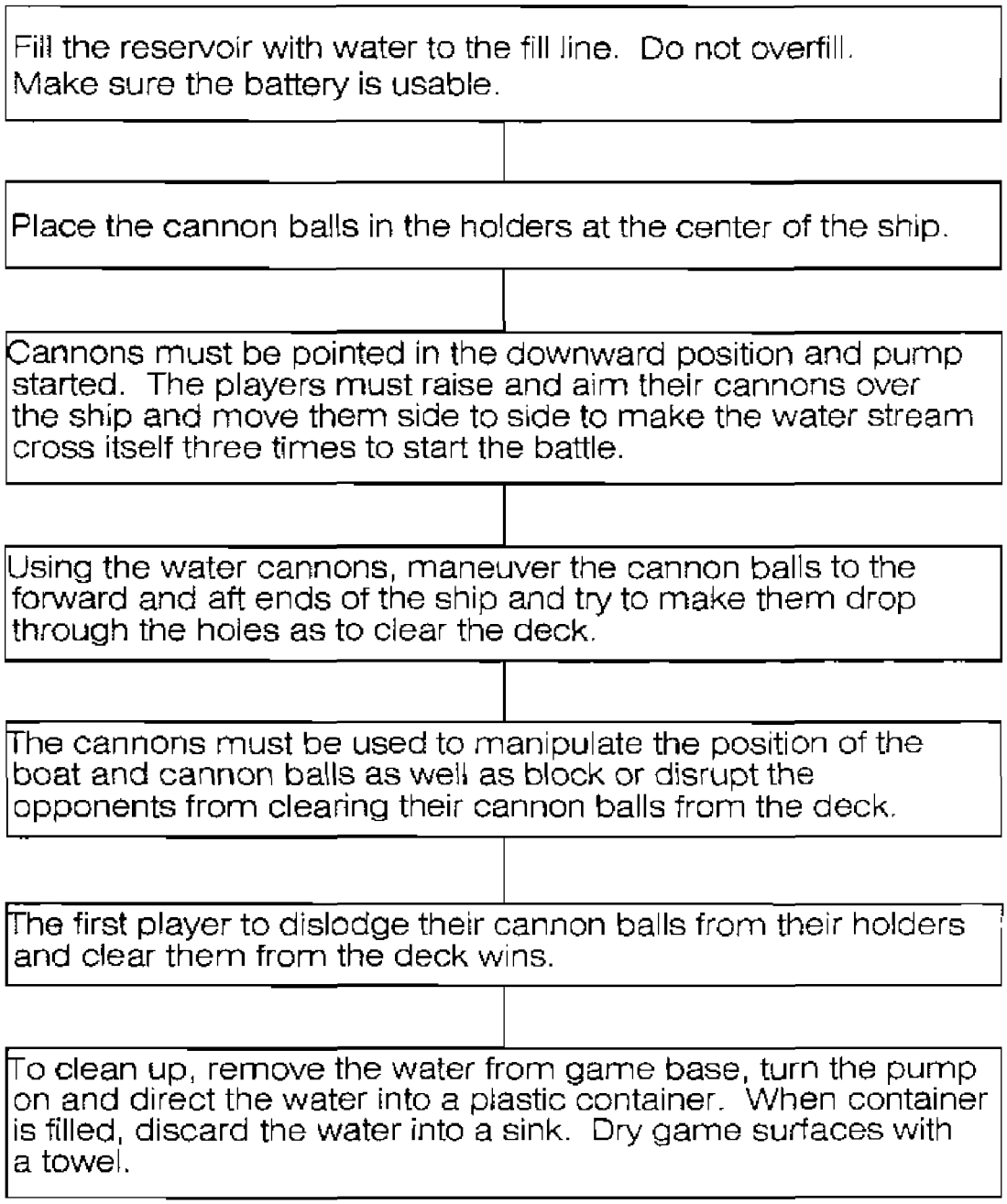
FIG. 7 is a block diagram of game procedure.

Referring to FIG. 7, game 10 procedures are detailed. The reservoir 17 is filled to the fill line 19. The cannon balls 80, each set a different color from the other, are each appropriately placed within the perches 76. One suggested beginning procedure calls or each player to begin by pointing cannons 40 downwardly, with pump 50 turned on. Opposing players must then elevate cannon 40 aim and cross water 90 streams three times before beginning, much as opponents might cross swords. The goal of each player is to move his or her colored cannon balls 80 into scoring holes 68, while attempting to block the other player from doing the same. The water 90 stream from the cannons 40 can spin the boat 55, dislodge either player's cannon balls 80, and herd a given player's cannon balls 80 toward or away from his objective holes 68. The first player to clear his cannon balls 80 from the deck 60 wins. As a vast majority of the water 90 is contained within the game 10, clean up is easily accomplished by simply turning on the pump 50 and allowing the hoses 48 to transport the water 90 to the cannons 40 and thus use the cannons 40 to fill any handy vessel for water 90 transport and disposal.

With respect to the above description then, it is to be realized that the optimum dimensional relationships for the parts of the toy water cannon game, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the toy water cannon game.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the toy water cannon game may be used.

Therefore, the foregoing is constructed as illustrative only of the principles of the toy water cannon game. Further, since numerous modifications and changes will readily occur to those skilled in the art, it is not desired to limit the toy water cannon game to the exact construction and operation shown and described, and accordingly, all suitable modifications and equivalents may be resorted to, falling within the scope of the toy water cannon game.

What is claimed is:

1. A toy water cannon game, comprising:

a square base having four spaced apart walls and a floor therebetween;

a reservoir in a center of the floor;

four spaced apart towers disposed on the base;

a water cannon pivotally disposed on at least two of each of the towers, an electrical pump supplying water from the reservoir to each cannon;

a boat disposed within the reservoir;

at least two cannon ball perches disposed on a deck of the boat, each perch removably holding a plurality of cannon balls;

at least two scoring holes within the deck for receipt of the cannon balls; and means for retrieving the cannon balls washed into the holes.

2. The game according to claim 1 wherein the floor further comprises a spaced apart plurality of compass points comprising North, South, East and West.

3. The game according to claim 2 wherein the floor further comprises a rib between each compass point.

4. The game according to claim 1 further comprising a means for recycling the water used by the cannons.

5. The game according to claim 2 further comprising a means for recycling the water used by the cannons.

6. The game according to claim 3 further comprising a means for recycling the water used by the cannons.

7. The game according to claim 4 wherein the boat disposed within the reservoir is further free to rotate.

8. The game according to claim 5 wherein the boat disposed within the reservoir is further free to rotate.

9. The game according to claim 6 wherein the boat disposed within the reservoir is further free to rotate.

10. A toy water cannon game, comprising:

a square base having four spaced apart walls and a slanted floor therebetween;

a reservoir in a center of the floor;

a plurality of spaced apart compass points on the floor comprising North, South, East, and West, a rib between each compass point;

four spaced apart towers disposed outwardly on the base;

a water cannon pivotally disposed on a swivel on at least two of each of the towers, an electrical pump supplying water from the reservoir to each cannon;

an unsinkable boat disposed within the reservoir, the boat having a hull topped by a removable deck;

at least two cannon ball perches on the deck, each perch removably holding a plurality of cannon balls;

at least two scoring holes within the deck for receipt of cannon balls.

11. The game according to claim 10 further comprising a means for limiting pivot of the cannons.

12. The game according to claim 11 wherein cannon pivot is further limited to about 40 degrees.

13. The game according to claim 10 further comprising a means for recycling the water used by the cannons.

14. The game according to claim 11 further comprising a means for recycling the water used by the cannons.

15. The game according to claim 12 further comprising a means for recycling the water used by the cannons.

16. A toy water cannon game, comprising:

a square base having four spaced apart walls and a slanted floor therebetween;

a circular reservoir disposed centrally in the floor, a top of the reservoir lower than the floor whereby water drains from the slanted floor into the reservoir, the reservoir further comprising a central rotational platform;

four spaced apart towers disposed on the base, at least two of each of the towers having a swivel, each tower further having a pair of spaced apart limits adjacent to the swivel;

a water cannon pivotally disposed on each swivel, a limit tab of each cannon in rotatable contact with the tower limits, whereby cannot pivot is limited;

an electrical pump supplying water from the reservoir to each cannon;

a boat removably disposed within the reservoir, the boat having a hull topped by a removable deck, the hull having a sleeve for pivotal fit to the rotational platform, the sleeve and rotational platform providing a realistic floating appearance in supporting the unsinkable boat, the sleeve and rotational platform in open communication with the reservoir, whereby water in the boat drains;

at least two rectangular cannon ball perches with perch walls, each perch disposed on the deck, each perch further comprising a central elongated channel, each perch removably holding a plurality of cannon balls, an outlet in the perch walls of each perch for cannon ball escape, an access in the perch wall opposite the outlet of each perch;

at least two scoring holes within the boat deck for receipt of cannon balls;

a plurality of masts removably fitted to the deck;

at least two damage sites on the deck, each damage site having a centrally disposed detent;

a pair of spaced apart treasure chests on the deck;

a plurality of obstacles on the deck.

17. The game according to claim 16 wherein cannon pivot is further limited to about 40 degrees.

* * * * *